US005870966A

United States Patent [19]

Christian

[11] Patent Number: 5,870,966

[45] Date of Patent: Feb. 16, 1999

[54] FOLDING PONTOON BOAT

[75] Inventor: James Randall Christian, 243 Bluffview, China Spring, Tex. 76633

[73] Assignee: James Randall Christian, China Spring, Tex.

[21] Appl. No.: 122,843

[22] Filed: Jul. 27, 1998

[51] Int. Cl.[6] ..... B63B 7/00

[52] U.S. Cl. ..... 114/353; 114/61; 114/283

[58] Field of Search ..... 114/352, 353, 114/354, 61, 283, 292

[56] References Cited

U.S. PATENT DOCUMENTS

| | | | |
|---|---|---|---|
| 3,193,851 | 7/1965 | Fiebelkorn | 114/61 |
| 3,877,094 | 4/1975 | Kelly | 114/61 |
| 4,768,454 | 9/1988 | Selken | 114/353 |

*Primary Examiner*—Jesus D. Sotelo

[57] ABSTRACT

A folding pontoon boat to be typically used by one person. Consisting of a semi flat midsection which pivots about it's center axis. A plurality of pontoons are attached to the starboard and port sides of the midsection. Said pontoons pivot beneath the midsection and the front pontoons fold on top of the aft pontoons when the midsection is folded. The boat contains an elevated seat support assembly which automatically collapses into the midsection as the midsection is folded. In the stowed position wheels extend below the aft pontoons to permit maneuverability over land. As an alternative storage means the pontoons may be disconnected from the midsection by removing the pontoon pivot pins. Additional seating can be easily attached to the current invention. Additionally two or more of the current invention can be attached together to form a larger boat.

7 Claims, 4 Drawing Sheets

FOLDING PONTOON BOAT

BACKGROUND OF THE INVENTION

There is a population of individuals who have limited storage space, limited means to transport a boat, limited access to the water and the limitation of a single individual handling the boat without assistance from others. The present invention provides two storage options. The boat can be folded to a compact position without removing a plurality of fasteners. The pontoons pivot from beneath the midsection to the operational position. This is extremely critical because it allows the natural force of the water surface to assist in maintaining the pontoons in their operational position. Additionally if storage or transportation requires, the boat can easily be disassembled by removing the pontoon pivot pins. The present invention also provides an elevated seat mount which automatically folds into the compact midsection as the boat is stowed. Four permanently attached wheels allow the present invention to be easily maneuvered while in the stowed position. Due to it's stowed size and mobility the present invention excels when access to the water is limited by obstacles.

Prior art is consist of one or more of the following limitations:

- small pontoon boats that do not fold.
- boats which must be disassembled for compact storage.
- boats dependent on bulky hulls between the pontoons for buoyancy
- boats containing elevated seats which either do not fold or do not fold automatically to a compact configuration.
- boats which require a plurality of fasteners to be removed for boat storage.
- boats which consist of long pontoons limiting storage.
- boats too large for single individual to easily transport and launch.

SUMMARY OF THE INVENTION

It is an object of the current invention to provide a lightweight, collapsible boat which can be easily transported and stowed in a small space by a single individual. The current invention provides a plurality of pontoons on the starboard and port side of the midsection providing stability on the water. The current invention incorporates a raised seat for operator comfort and maneuverability. One aspect of the current invention is it can easily be folded for storage or transportation. In still another aspect of the current invention, there is a means for the pontoons to be easily removed if required for transportation or storage. Latches lock the pontoons and midsection into the operational position. The raised seat support assembly is automatically retracted as the midsection of the current invention is folded together. As the midsection is unfolded the seat support assembly is automatically raised to it's operational position. The seat support assembly is encased by the compact midsection when in the stowed position. In it's stowed configuration the current invention exposes a plurality of wheels on it's underside allowing an individual to easily maneuver it on land.

DETAILED DESCRIPTION OF THE DRAWINGS

Figure 1:
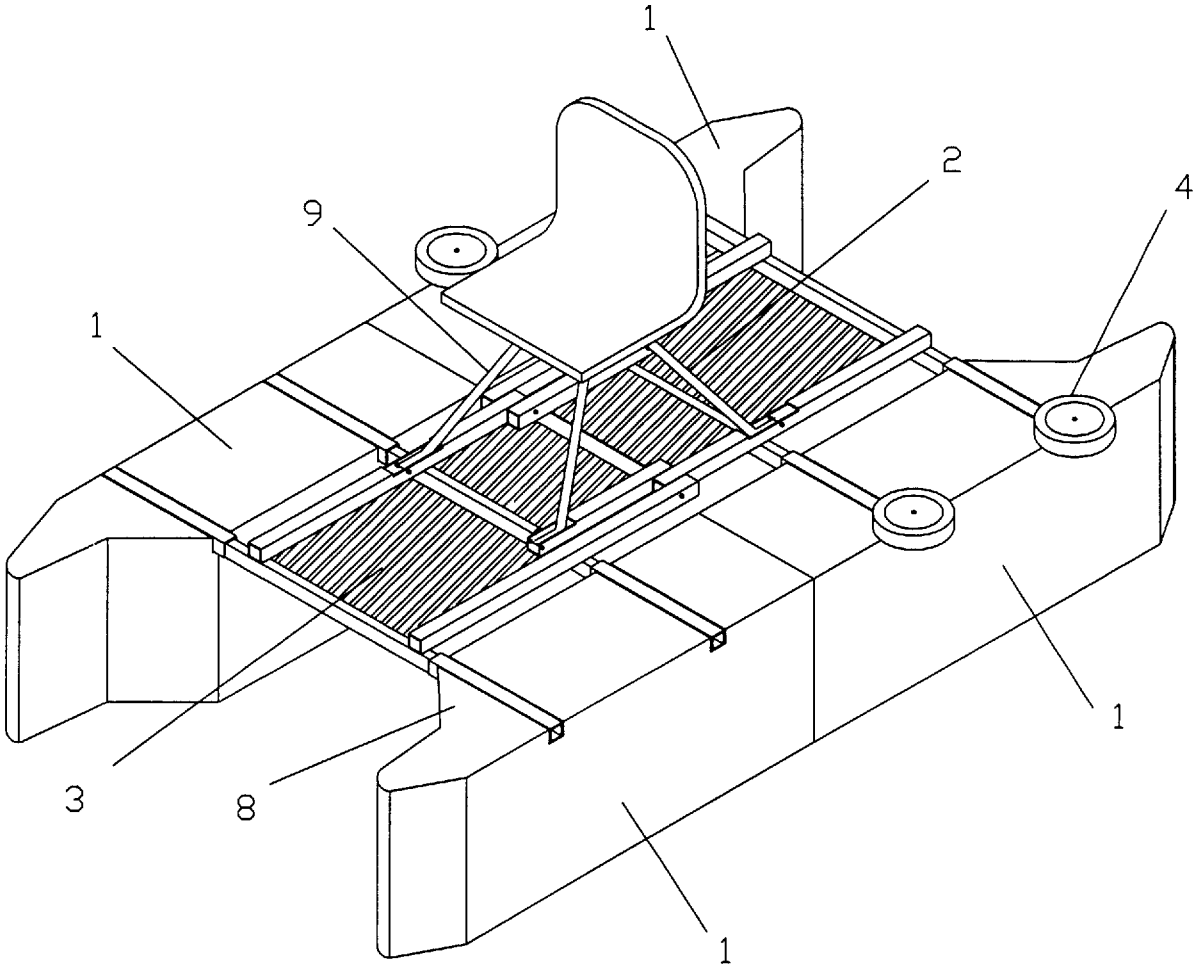
FIG. 1 overall view of the current invention
Figure 2:
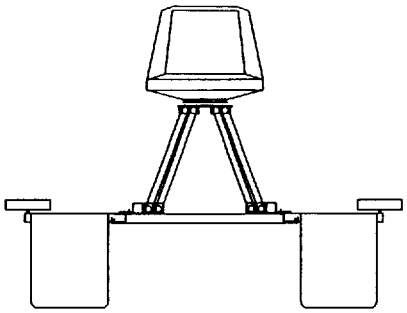
FIG. 2 illustrates a front view of the current invention in it's operational position
Figure 5:
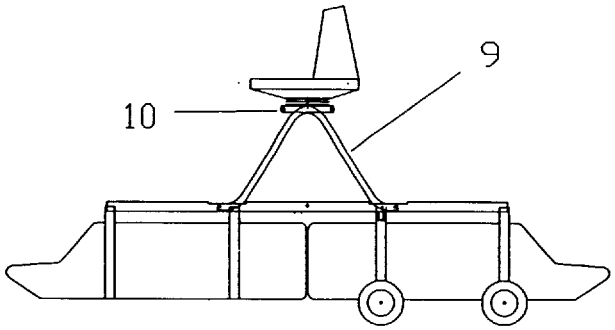
FIG. 5 illustrates a side view of the current invention with the pontoons fully folded and the mid section still in the operational position.
Figure 3:
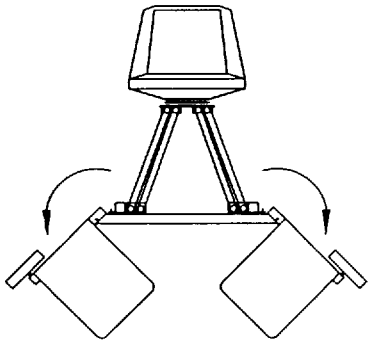
FIG. 3 illustrates a front view of the current invention with the pontoons folding beneath the mid section.
Figure 6:
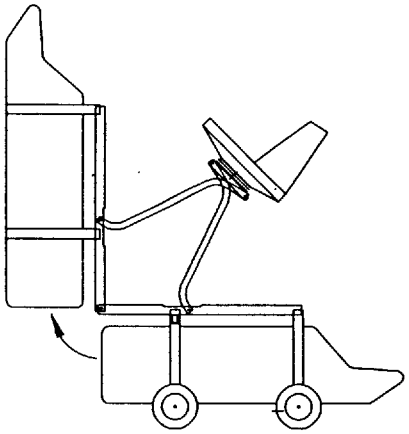
FIG. 6 illustrates the midsection being folded and the seat support assembly collapsing.
Figure 4:
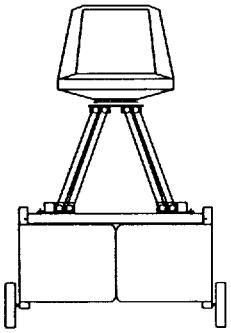
FIG. 4 illustrates a front view of the current invention with the pontoons completely folded beneath the midsection.
Figure 7:
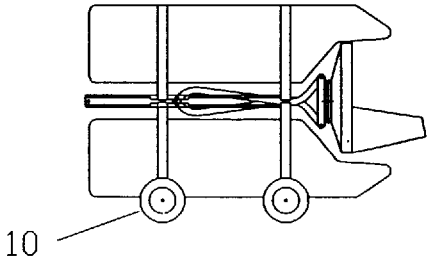
FIG. 7 illustrates the current invention in the stowed position.
Figure 8:
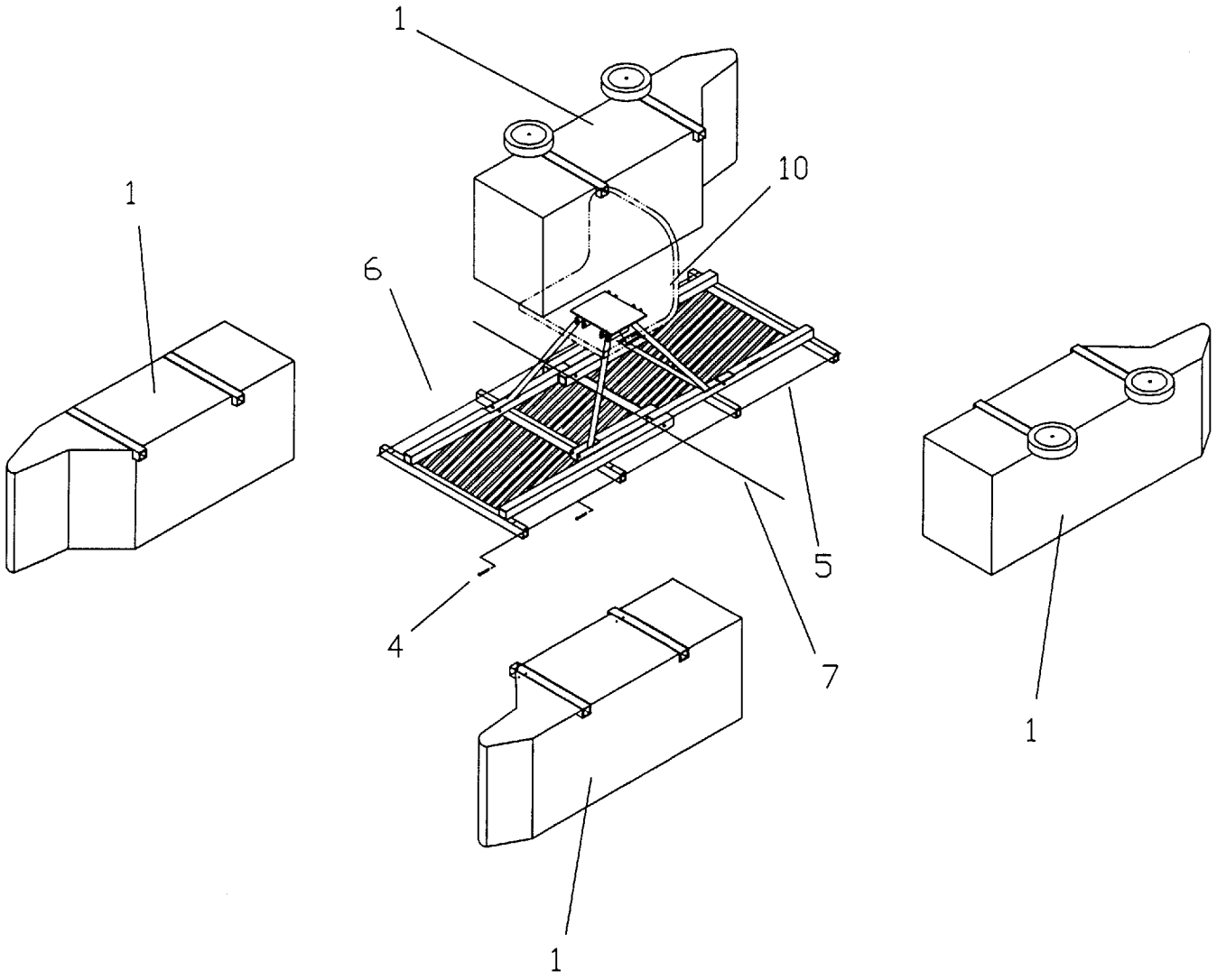
FIG. 8 illustrates the pontoons removed.
Figure 9:
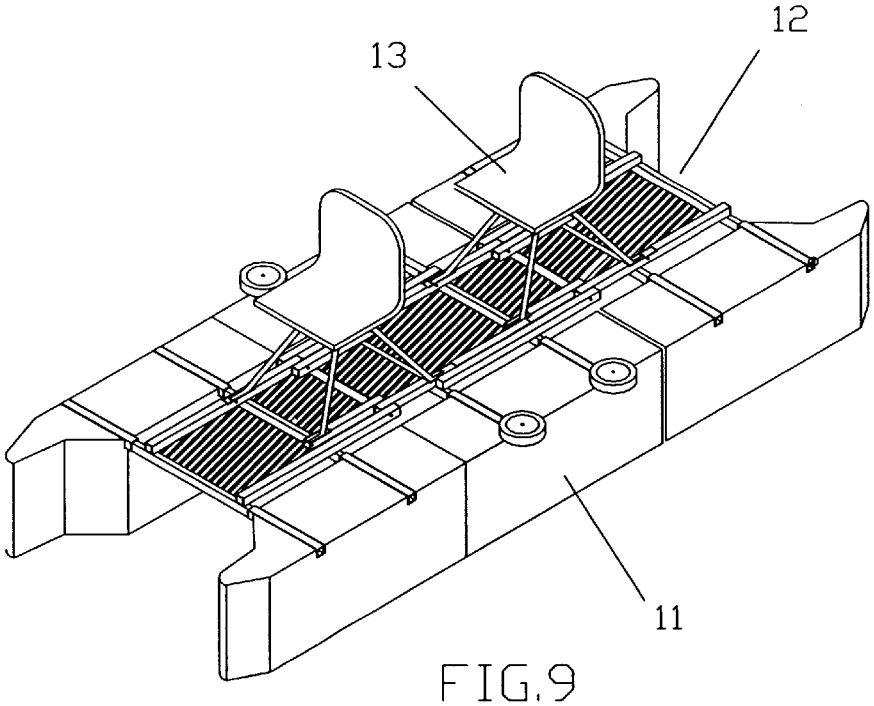
FIG. 9 illustrates the attachment of an additional seating section to the current invention.
Figure 10:
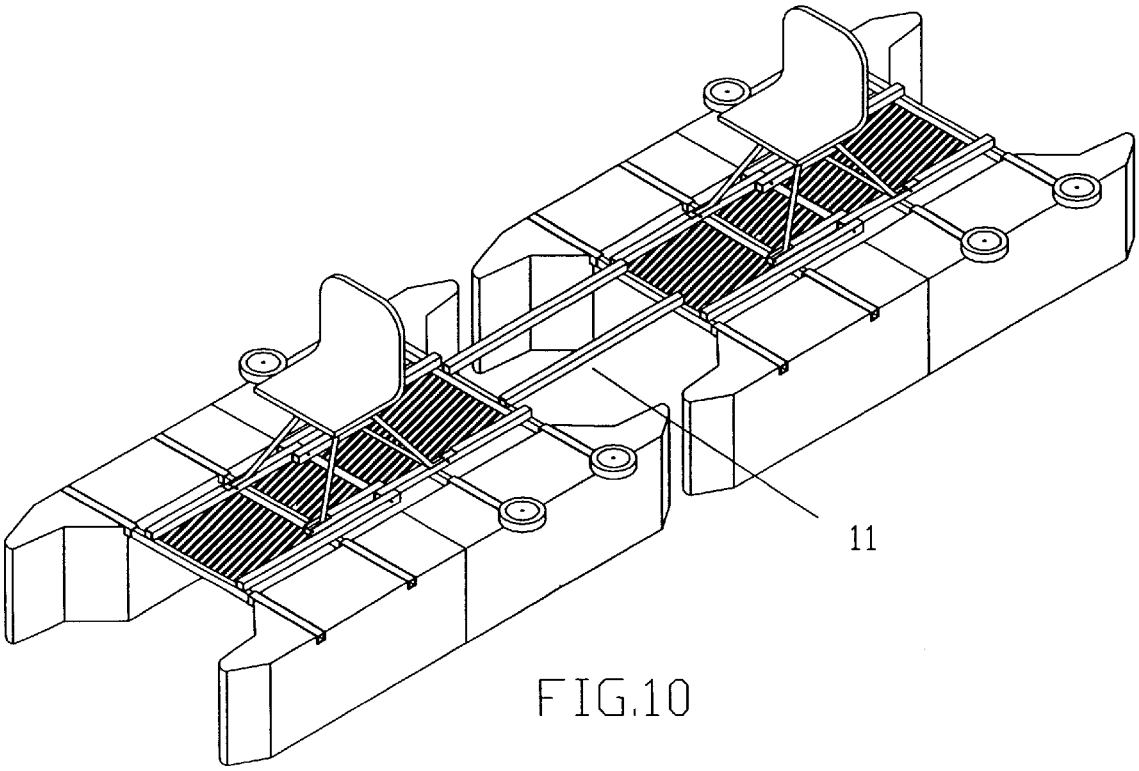
FIG. 10 illustrates two of the current inventions attached together.

In FIG. 1 the present invention is shown in it's operational position. The present invention provides a plurality of pontoons(1) on the starboard and port side of the midsection (3) providing stability on the water. The pontoons are fabricated of approximately ⅛ to ¼ inch thick plastic, wood, or aluminum. Attached to the top surface of each pontoon(1) is two pontoon supports(8) fabricated from square aluminum tubing. The pontoon supports(8) act as a means to attach the pontoons(1) to the midsection(3) and support the midsection during operation. The present invention incorporates a raised seat support assembly(2) for operator comfort and maneuverability. FIGS. 2, 3, and 4 show a front view of the present invention as the pontoons(1) pivot beneath the midsection(3). This reduces the overall width of the present invention by approximately half of it's operational position. The midsection(3) pivots about the midsection pivot axis(7) running through its center from starboard to port side. As shown in FIGS. 5, 6 and 7 the forward section of the midsection(3) and the forward pontoons pivot about the midsection pivot axis(7) approximately 180 degrees. As shown in FIG. 8 the seat support assembly consist of four legs(9) formed from thin wall round aluminum tubing and a seat mount (10). The legs(9) are formed in a fashion to allow them to nest inside the folded midsection(3) of the present invention. Each leg(9) is attached to the midsection by an attachment pin and to the seat mount(10) by another pin. FIGS. 5, 6 and 7 illustrate as the midsection(3) is folded the legs(9) of the seat support assembly(2) pivot about their attachment pins causing the seat mount assembly to automatically fold compactly inside the folded midsection(3). Conversely as the midsection(3) is unfolded the seat support assembly(2) is automatically raised to it's operational position. The pontoon supports(8) on the rear half on have four wheels(4) mounted on them. These wheels(4) extend past the outer edge of the pontoons(1) and contact the ground when the present invention is in the stowed position as shown in FIG. 7. These wheels(4) allows the present invention to be easily maneuvered on the ground while in the stowed position. If required for storage or transportation the pontoons(1) can easily be removed from the midsection(3) by removing the pontoon pivot pins(4) as shown in FIG. 8. This allows for segments of the current invention to be stored and transported individually. As shown in FIG. 9 to add additional seating to the current invention an additional midsection (12) and seat assembly(13) is attached to the current midsection(3) and the two rectangular pontoons(11) placed in-between the current pontoons(1). For storage the additional midsection(12) is unattached from the current midsection(3) allowing both midsections to fold to a compact form. FIG. 10 shows an attachment bracket(14) which is used to connect two or more of the current inventions together.

I claim:

1. A collapsible pontoon boat comprising a:

A substantially flat midsection which folds about an axis running from starboard to port located at the midsection's center; the midsection folds to a compact form encasing a seat support assembly;

a plurality of pontoons on the starboard side running parallel to a plurality of pontoons on the port side are attached to the midsection; wherein when in the operating position one set of pontoons are spaced a distance from the other set to give optimum stability on the water;

the pontoons pivot about an axis extending fore and aft on each side on the midsection; the pontoons pivot about said axis to a position beneath the lower surface of the midsection;

a seat support assembly elevated above the top surface of the midsection; the seat support assembly folds to a compact form inside the midsection as the midsection is folded and automatically raises to an elevated position as the midsection is unfolded to the operational position.

2. A boat as in claim 1 further comprising a plurality of wheels which are mounted on the pontoons and contact the ground when the boat is in the stowed position.

3. A boat as in claim 1, further comprising pivot pins for connecting said pontoons whereby said pontoons can be disconnected from the midsection by removing the pivot pins.

4. A boat as in claim 1 wherein said pontoons are rigid.

5. A boat as in claim 1 wherein said pontoons are inflatable.

6. The boat of claim 1 including means to attach a plurality of boats together.

7. The boat of claim 1 including a plurality of seat assemblies.

* * * * *